United States Patent [19]

Lala

[11] 4,233,897

[45] Nov. 18, 1980

[54] LONG STROKE ATTACHMENT FOR A SCREEN PRINTING MACHINE

[75] Inventor: Louis A. Lala, Chicago, Ill.

[73] Assignee: American Screen Printing Equipment Company, Chicago, Ill.

[21] Appl. No.: 936,329

[22] Filed: Aug. 24, 1978

[51] Int. Cl.[3] ..... B05C 17/04

[52] U.S. Cl. ..... 101/123; 101/124

[58] Field of Search ..... 101/123, 124

[56] References Cited

U.S. PATENT DOCUMENTS

| | | | |
|---|---|---|---|
| 915,229 | 3/1909 | Shields | 270/30 |
| 3,090,300 | 5/1963 | Dubuit | 101/123 |
| 3,762,318 | 10/1973 | Dubuit | 101/124 |

*Primary Examiner*—Edgar S. Burr
*Assistant Examiner*—A. Heinz
*Attorney, Agent, or Firm*—Robert E. Wagner; Gerald T. Shekleton

[57] ABSTRACT

A screen printing machine is described which multiplies the normal carriage stroke of a printing machine to allow printing on the surfaces of large objects of revolution. The drive means comprises a sprocket-chain assembly with a chain connected to the carriage drive for following its lateral reciprocal movement. The sprocket is fixedly mounted in axial alignment with a pinion gear for rotation about that axis. The pinion gear in turn is engaged with a rack gear mounted on the screen. As the sprocket rotates, the pinion gear drives the rack and screen in lateral motion. The ratio of pinion gear diameter size to sprocket diameter size governs the stroke length of the screen. With a large (2 to 1 or 3 to 1) ratio the screen stroke or lateral movement of the screen may be doubled or tripled in length.

3 Claims, 5 Drawing Figures

LONG STROKE ATTACHMENT FOR A SCREEN PRINTING MACHINE

RELATED APPLICATIONS

The present application relates to United States Patent application Ser. No. 927,553 for a Silk Screen Printing Machine, filed July 24, 1978.

BACKGROUND OF THE INVENTION

1. Field of the Invention

The present invention relates to printing machines, and more particular, to silk screen printing machines capable of printing on a variety of geometric configurations.

2. Prior Art

Silk screening is of course an ancient art, but it has been modernized to significant extents as a result of automation or semi-automation of the equipment utilized to produce the silk screening designs. One of the major commercial applications today is in the printing of bottles and plastic containers of various geometric configurations and surfaces of revolution such as for example, cylindrical, oval and rectangular.

In some operations of printing such geometrically configured containers and the like, it is necessary to hold the silk screen stationary while moving the squeegee across the surface of the silk screen in order to pass the printing liquid through the screen and create the design. In still other applications it is necessary to reciprocate laterally the silk screen while maintaining the squeegee stationary in engagement with the surface of the screen in order to pass the printing liquid through the screen.

Since silk screen printing machinery is often utilized for a variety of applications it must generally be adaptable to either mode of operation. The present invention, however, is more closely relatd to those silk screen printing apparatus when used in such a manner that the silk screen is reciprocated laterally. When the silk screen machine is set up in this manner, i.e. to reciprocate the silk screen laterally while holding the squeegee stationary, it is generally used on objects which possess surfaces of revolution that are to be printed on, such as cylindrical containers. The container is positioned beneath the squeegee so that the surface rotates parallel to and in tangential contact with the squeegee as the silk screen with the printing liquid is passed therebetween. Many such existing machines are capable of only printing on such containers which have a relatively small diameter. This is true even though there is additional room for laterally reciprocable movement of the silk screen carrier within the frame structure of the printing apparatus, since in many such apparatus there is an interference with the further outward movement of the silk screen carrier, with other parts of the machine. Thus, such machines cannot be utilized to their fullest to accomodate larger diameter containers or to print over a greater extent of surface area on a container because of this limited movement.

SUMMARY OF THE INVENTION

The present invention overcomes the above described disadvantages and difficulties associated with such prior art machines by providing a long stroke attachment which will extend the permissable lateral reciprocable movement of the silk screen carrier so as to accommodate larger sizes of containers and to print greater surface areas around the containers.

This is accomplished by providing an attachment which is securable to the existing silk screen carrier support means on a silk screening machine, which can move generally up and down with the silk screen carrier for movement toward and away from the object as is conventionally done with the basic silk screen carrier and squeegee, but which extends the movement of the existing silk screen carrier by translating it to a means for supporting a silk screen such that it can be moved a greater distance laterally during the extent of movement of the conventional silk screen carrier.

This device of the present invention is particularly adapted for use with silk screen machines which have separately movable squeegee carriers and screen carrier support means which permit them to be moved relative to one another as they are both moved upwardly and downwardly relative to the objects being printed. In such devices, for example as that disclosed in applicant's above referred to copending application, the silk screen carrier is moved substantially vertically upward with its support means while the squeegee and its carrier and support means are rotated somewhat through a parallelogram linkage activated by the upward movement of the squeegee carrier support means. However, this device of the present invention is also usable on such devices where both the silk screen carrier and the squeegee carrier are rotated upwardly away from the object at the end of the printing stroke, such as is disclosed for example in Dubuit U.S. Pat. No. 3,090,300.

In both of these above referred to types of silk screening machines, a means is provided for laterally reciprocating the silk screen carrier on the silk screen carrier support means while holding the squeegee stationary in order to print on the surface of containers having surfaces of revolution. The present invention is securable to the means supporting the silk screen carrier by an attachment support means a part of which is laterally stationary securable to the means supporting the silk screen and movable with the silk screen carrier towards and away from the object being printed on while a second part is securable to said silk screen carrier for lateral movement therewith. A rack member is supported by the attachment support means for lateral reciprocable movement relative to the squeegee carrier; a pinion gear is mounted for rotation on the attachment support means in drive engagement with the rack member; drive means are provided having a flexible connector secured at each end to remote portions of the screen carrier on opposite sides of the squeegee, and having a rotary drive member in engagement with the flexible connector and connected to the pinion gear for causing rotation thereof upon lateral reciprocable movement of the screen carrier; and means for laterally adjustably securing a silk screen to the rack member for movement therewith.

In its preferred form, the attachment means has at the first part mentioned above, a central bracket secured adjacent the squeegee carrier to the means supporting the screen carrier for its up and down movement, and in addition it supports the pinion gear in engagement with the rack member; the rack member being free to move laterally through the central bracket. The second part of the attachment support means includes a rack support which is securable to the screen carrier at remote locations on opposite sides of the squeegee for supporting the rack member for its lateral movement upon rotation of the pinion gear. The gear support means preferably takes the form of a pair of rack support brackets each securable to a respective screen carrier bracket on opposite sides of the squeegee for lateral movement with the screen carrier brackets, and a plurality of rollers secured to each of the rack support brackets for rotation and in engagement with the outer end portions of the rack member for supporting it for lateral movement relative to the screen carrier.

The flexible connector is preferably a drive chain and the rotary drive member is a sprocket meshed therewith, the sprocket being supported on a common shaft with the pinion gear so that rotation of the sprocket by movement of the drive chain causes rotation of the pinion gear which in turn causes lateral movement of the rack member. The pinion gear and/or the sprocket forming the rotary drive member can have their relative pitch diameters increased or decreased in order to change the ratio of lateral movement between the silk screen carrier and the rack member so as to extend the movement of the rack member beyond the movement of the silk screen carrier.

In addition, it is preferable to provide a pair of guide members also preferably in the form of gears which intermesh with the drive chain in order to wrap the chain around a portion of the rotary drive member or sprocket so as to maintain the chain in driving engagement with the drive sprocket.

Thus it can be seen that as the silk screen carrier which forms a part of the original machine is reciprocated laterally both during the printing operation and during the return stroke, the rack member and thus the means secured thereto for supporting a silk screen will be moved a greater distance than the normal movement of the silk screen carrier to an extent which is directly proportional to the ratios of the drive sprocket and the pinion gear in engagement with the rack member. This can then be utilized to substantially extend the lateral movement of a silk screen and thus increase the printing distance so that larger areas such as would be encountered on the surfaces of relatively larger diameter containers can be printed.

DETAILED DESCRIPTION OF THE PREFERRED EMBODIMENT

Figure 1:
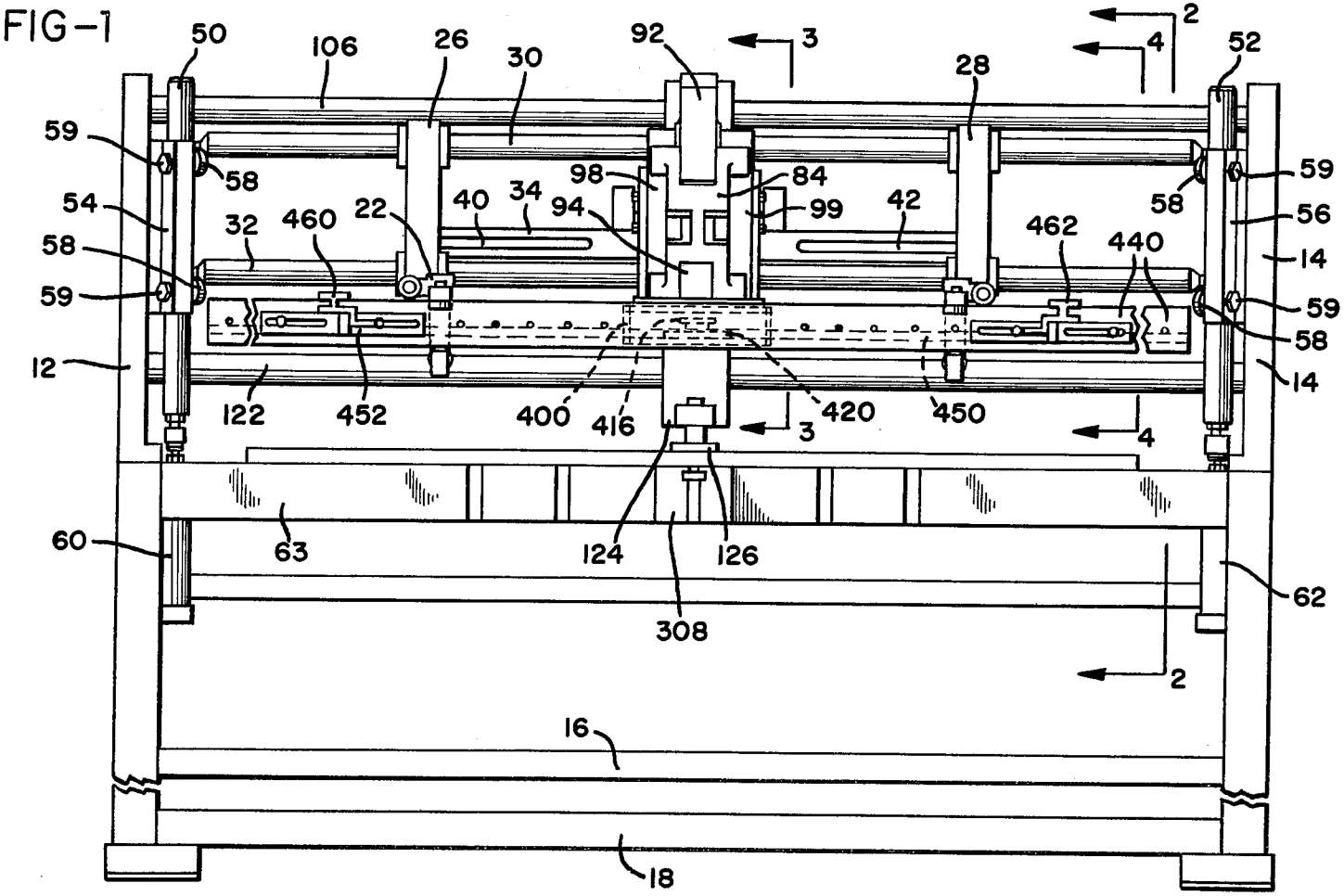
FIG. 1 is a front elevational view of the attachment means of the present invention secured to a preferred form of silk screen printing machine with portions of the machine removed for clarity.
Figure 2:
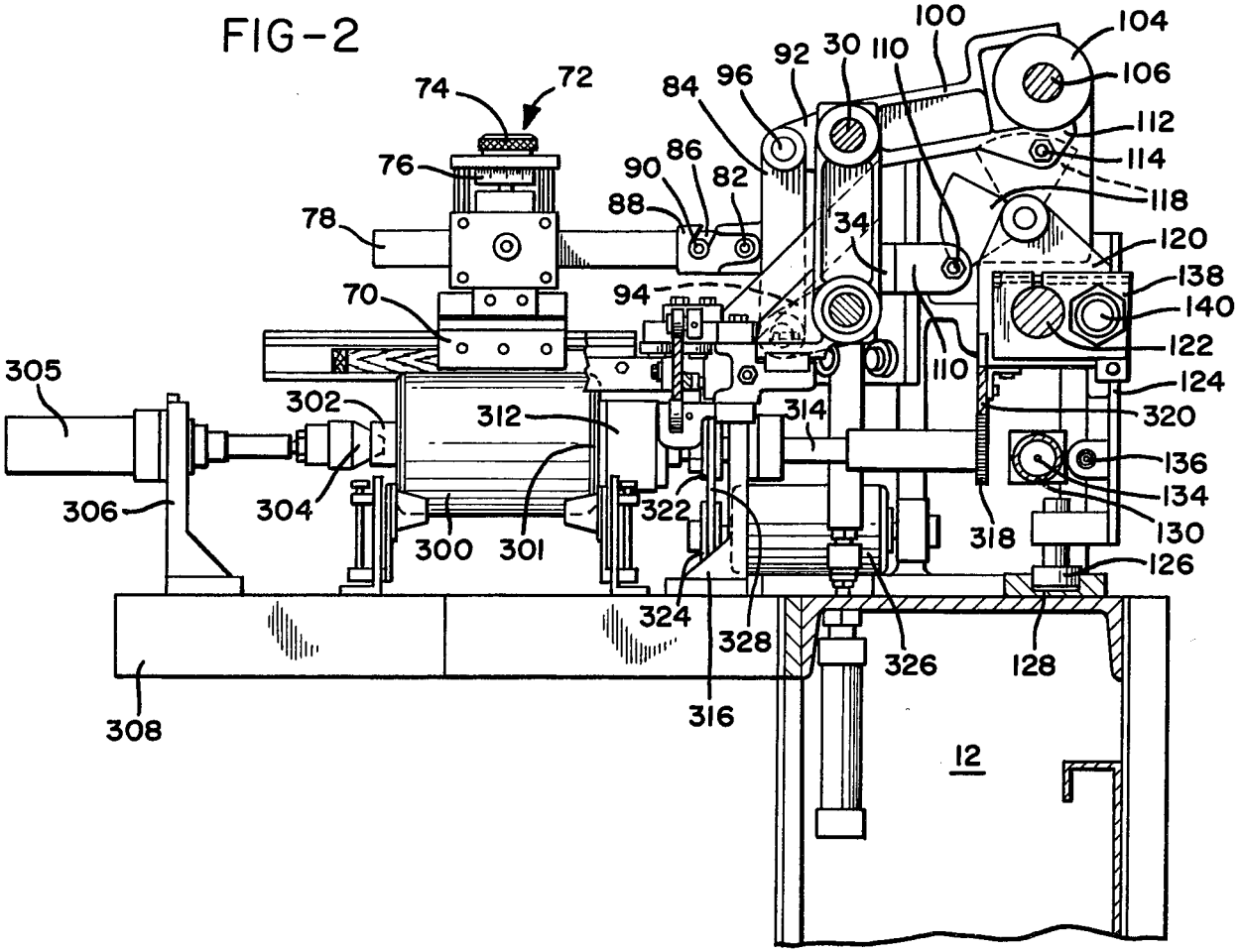
FIG. 2 is a cross sectional view of the apparatus of FIG. 1 along the line 2—2 with the object support mechanism and squeegee support mechanism shown in their positions although not illustrated in FIG. 1.

Referring first to FIGS. 1 and 2 and a description of the machine on which the attachment of the present invention is employed, the main machine frame consists generally of vertical side structures 12 and 14 which are held rigid by a plurality of horizontal braces such as 16 and 18.

A silk screen carrier is generally composed of a pair of horizontally extending support bars 22 and 24 (see FIG. 5) which extend in cantilever fashion outwardly in parallel spaced relation from a pair of vertically extending carrier support members 26 and 28. Carrier support members 26 and 28 are in turn slidingly supported at their upper and lower ends on upper and lower cylindrical rods 30 and 32 which are disposed in spaced parallel horizontal position with the carrier support members 26 and 28 being slidable laterally in either direction thereon, as shown in FIG. 1.

A connector bar 34 is bolted at each end to the carrier support members 26 and 28 through elongated slots 40 and 42 formed in the connecting bar 34 so that the support bars 22 and 24 may be separated a desired distance.

Cylindrical support rods 30 and 32 are secured at each of their ends by a pair of spaced vertically extending end bars 50 and 52. End bars 50 and 52 are supported on the main machine frame so as to be movable vertically up and down, but are otherwise captive. To hold the end rods 50 and 52 for movement, a pair of channel members 54 and 56 are utilized which are secured to the main vertical side structures 12 and 14 respectively. The vertically extending end rods 50 and 52 are cylindrical and are supported in channel members 54 and 56 by a plurality of rollers 58 disposed at equal radial distances about each of the vertically extending end rods 50 and 52 so as to support them for vertical movement. Bolts 59 are used to support the outer pair of rollers 58 in an adjustable manner so that end rods 50 and 52 can be removable from the channel members 54 and 56 and can be held in engagement with each of the rollers 58 by adjustment of the screws 59.

The vertically extending end rods 50 and 52 are connected at their lower ends respectively to double acting pneumatic cylinders 60 and 62 secured to a horizontal base plate 63 mounted between vertical side structures 12 and 14 of the machine frame. Pneumatic cylinders 60 and 62 thus move end rods 50 and 52 upwards or downwards, simultaneously on command as described in applicants above referred to copending application, incorporated hereinto by reference thereto.

Referring now to the squeegee carrier mechanism, the squeegee 70, as shown in FIG. 2, is supported by a vertical adjustment mechanism 72 which permits accurate vertical adjustment of the squeegee 70 relative to the surface of the silk screen. The squeegee 70 is carried on the lower portion of the adjustment mechanism 72 through a threaded member positioned internally thereof and secured at its upper end to the circular knob 74 which is used to rotate the threaded member in order to cause vertical movement of the squeegee 70. A cylindrical calibrated dial 76 is provided in order to permit more exact adjustment of the position of the squeegee 70 relative to the silk screen surface.

The vertical adjustment mechanism 72 is supported for sliding movement on a horizontally extending bar 78 so that the squeegee 70 can be positioned properly in the fore and aft direction relative to the screen 20. The vertical adjustment mechanism 72 can then be held in position on bar 78 by the friction screw 80 which can be tightened against the side of the bar 78.

The bar 78 is in turn pivotally secured at its inboard end by pin 82 to a vertically extending support member 84. A slotted opening 86 is provided in the extended portion 88 of the vertical support member 84 and is slanted to permit pivotal movement of the bar 78 and thus the vertical support mechanism 72 and squeegee 70 so that the squeegee 70 can be manually rotated away from the silk screen surface during assembly or servicing of the equipment. The bottom of the slot 86 acts as a position stop for the pin 90 secured to the bar 78 so that the bar 78 will be disposed in a horizontal position when the pin 90 is at the bottom of the slot 86.

The vertically extending support member 84 is in turn pivotally connected at its upper and lower end portions respectively to upper and lower tie rods 92 and 94 by pins 96 and 97 which extend through the vertically extending member 84 and tie rods 92 and 94. The other end of the tie rods 92 and 94 are in turn pivotally mounted to upper and lower horizontally extending support bars 30 and 32 and are free to move laterally along the support bars 30 and 32, independently of the movement of the carrier support member 26 and 28.

A pair of auxiliary support plates 98 and 99 are placed in engagement with and on opposite sides of tie rods 92 and 94 and have their upper and lower end portions provided with holes through which support bars 30 and 32 pass. These plates are utilized to support portions of the long stroke attachment of the present invention as described below.

The upper tie rod 92 has a further extended end portion 100 which extends rearward beyond the upper support bar 30 and has a U-shaped opening which engages a corresponding collar 104 that maintains the end portion 100 captive for lateral movement along a guide bar 106 which in turn is secured at each end to the vertical side structures 12 and 14.

Thus, when the vertically extending end rods 50 and 52 are moved upwardly from the position shown in FIG. 2 the captive extended end portion of upper tie rod 92 will cause the tie rods to be pivoted about the upper support bar 30 thus moving the vertical support member 84 rotationally upwardly due to the parallelogram linkage established by rigidly secured rods 30 and 32, vertically extending support member 84 and upper and lower tie rods 92 and 94. This in turn will cause upward rotational movement of squeegee 70 relative to the silk screen, as described below. Likewise, when the vertically extending end rods 50 and 52 are lowered, the squeegee, through the same mechanism of parallelogram linkage, will be lowered into proper position relative to the silk screen for printing on the object.

Referring now to the manner in which both the silk screen carrier and the squeegee carrier are moved laterally on the horizontally extending support bars 30 and 32, it is only necessary to move one or the other of the mechanisms laterally depending on the type of the object being printed and therefore the following described mechanism is easily selectably positionable so as to move only either the silk screen or the squeegee 70 back and forth on horizontal support bars 30 and 32.

First, with regard to the silk screen carrier lateral movement, the connecting bar 34 is further provided upon its back side with a U-shaped bracket 108, as best illustrated in FIG. 2, which is provided with a pair of pins 110 (only one shown), one extending through either tab portion of the U-shaped bracket 108 and threaded on the end extending through the bracket so that the inwardly protruding portion can be adjusted in order that the space between the inner adjacent ends of the pins 110 can be increased or decreased.

The extended portion 100 of upper tie rod 92 associated with the squeegee carrier mechanism likewise has a U-shaped bracket 112 depending downwardly therefrom, also as best illustrated in FIG. 2. This bracket further has a pair of pins 114 (only one shown) in the outer tab portions of the U-shaped bracket 112 which, like those in the U-shaped bracket 108, extend inwardly and are secured with a threaded portion and a nut so that the spacing between the inward adjacent end portions of the pins 114 can be adjusted.

A fan-shaped section 118 is pivotally mounted to a drive member 120. The fan-shaped section 118 is so positioned relative to the U-shaped brackets 108 and 112 that it can pass between the extended tab portions of either thereof so as to only engage one of the brackets at a time. The pins 110 and 114 respectively associated with the brackets 108 and 112 can be adjusted to be in fairly close proximity to the corresponding side portions of the fan shaped section so that there is little play in the reversing of the lateral movement between the drive member 120 and the U-shaped bracket engaged by the fan shaped section 118 and can in fact be brought into light engagement therewith to hold the fan-shaped section in place.

The drive member 120 is fitted on a further cylindrical rod 122 supported at each end in the vertical side structures 12 and 14 of the machine frame. In addition, a stabilizing support bracket 124 depends downwardly from the back surface of drive member 120 and has secured to the lower end portion thereof a roller 126 which rides in a keyway 128 defined in the frame structure so as to prevent binding of the drive member 120 as it slides along the further cylindrical rod 122.

A further double acting pneumatic cylinder 130 is supported between the vertical side structures 12 and 14 in parallel aligned relation to the further cylindrical rod 122 and adjacent the stabilizing support bracket 124. Although not illustrated herein, a belt is secured at its ends to a piston 134 in the cylinder 130 and is trained about a pair of pulleys mounted at each end of the cylinder 130 on the respective vertical side structures 12 and 14. On the run of the belt opposite the side connected to the piston 134, the drive means 120 is secured thereto by attachment to the bracket 136 as shown in FIG. 2.

Thus, it can be seen that movement of the piston 134 in either direction will result in corresponding movement of drive member 120 in the opposite direction. A pair of limit stop assemblies 138 (only one shown), as shown in FIG. 2, are adjustably secured to further cylindrical rod 122. This is preferably accomplished by using the split block with a screw extending through the split so that it may be tightened down onto the rod 122 at the desired lateral location. Each limit stop assembly 138 is provided with a two position pneumatic valve 140, each of which is respectively provided with a plunger, which is positioned to engage the drive member 120 as it approaches the respective limit stop. The details of the pneumatic system and its manner of operation are not important so far as the present invention is concerned and therefore further details are not necessary herein although reference can be made to applicant's above referred to application for a complete and concise explanation thereof.

With regard to the means for holding an object to be printed, if the object is a surface of revolution rather than a flat piece, it would be appropriate to hold the object in a stationary position while rotating it about it axis of symmmetry with the surface to be printed in a horizontal plane adjacent the squeegee 70 which is also held stationary, while moving the silk screen 20 back and forth using the pneumatic control mechanism just referred to above. To effect this operation the mechanism for holding an object such as a cylindrical bottle 300 is illustrated in FIG. 2.

A cylindrical bottle 300 can, for example, be a plastic, semi-flexible container with appropriate indentations on the bottom edge portion 301 thereof opposite the neck portion 302. The indentations are conventionally used to engage the bottom surface of the bottle with a driving mechanism in order to rotate the bottle as the silk screen is moved across its surface in order to place the design around the circumference of the bottle 300. The mechanism illustrated includes a centering spindle 304 which is driven axially into bottle 300 by air cylinder 305 and is supported by a bracket 306 secured to an extension 308 of the main machine frame.

The spindle 304 is hollow and air is introduced through the spindle to provide compressed air to the bottle 300 in order to maintain the printing surface under pressure so that it is more rigid than it would be if the inside of the bottle were open to atmosphere. The bottom portion 301 of the bottle is engaged with a cylindrical driving head 312 having pawls engagable with the indentations in the bottom 301 of bottle 300 and which is rotatably mounted on a shaft 314 supported by a bracket 316 mounted to the main machine frame.

On the remote portion of the drive shaft from the driving head 312 is mounted a gear 318 which engages a rack 320 mounted to the drive member 120 for movement therewith. Thus it can be seen that as the drive member 120 is moved back and forth across the width of the machine, the gear 318 is rotated so that the cylindrical surface of the bottle 300 is rotated in coordination with the movement of the silk screen to place the design on the surface of the bottle 300. The gear 318 may be changed to accomodate different diameters of bottle 300 so that the relative movement between the surface of the bottle and the silk screen is the same. In this regard the drive shaft 314 is adjustably positioned vertically in the bracket 316, as is the spindle 304 and associated air cylinder 310 in bracket 306.

In order to maintain the driving head 312 in engagement with the ratchet-type indentations in the bottom of bottle 300, a belt and pulley arrangement is utilized. Pulley 322 is mounted on the drive shaft for rotation therewith and pulley 324 is mounted to the drive shaft of a motor 326. A belt 328 is entrained about pulleys 322 and 324, such as, for example, a bungi cord can be used in order to permit the above referred to change in position of the drive shaft 314 for different types of bottles. In addition, the belt 328 is designed to slip on the pulley 322 and since the drive motor rotates pulley 324 at a higher rate of speed than is needed to rotate the drive shafts 314 in order to coordinate the movement of the surface of bottle 300 with that of the silk screen 20, the belt will slip and provide a positive engagement between the driving head 312 and the indentations on the bottom portion 301 of the bottle 300.

Figure 3:
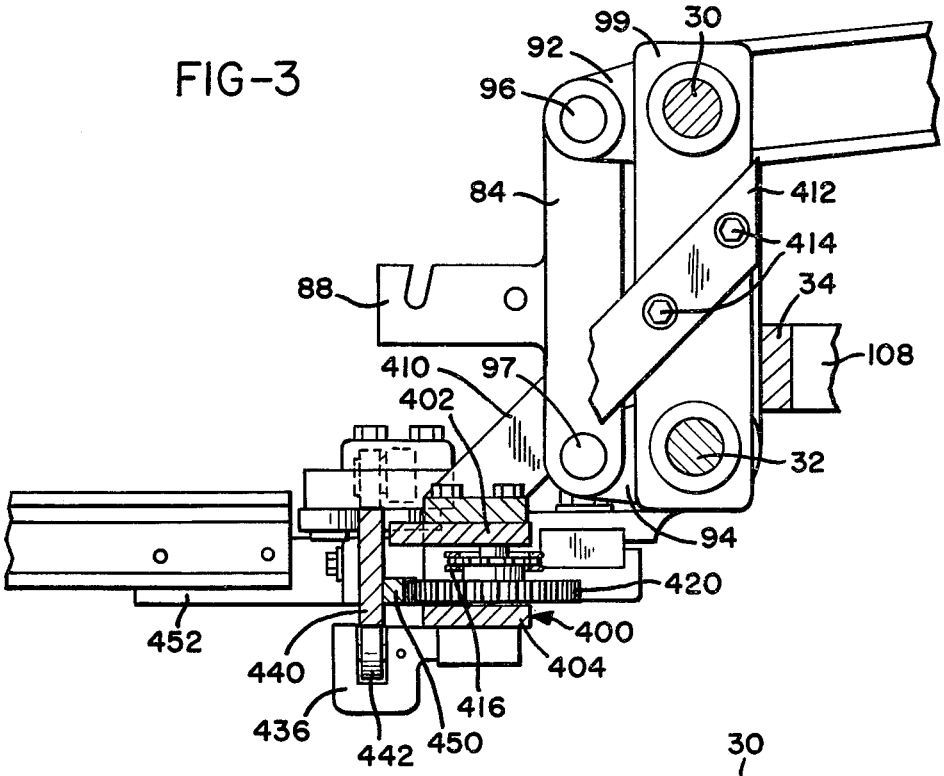
FIG. 3 is a partial cross sectional view along the line 3—3 of FIG. 1 showing a cross section through the central bracket portion of the attachment device.
Figure 4:
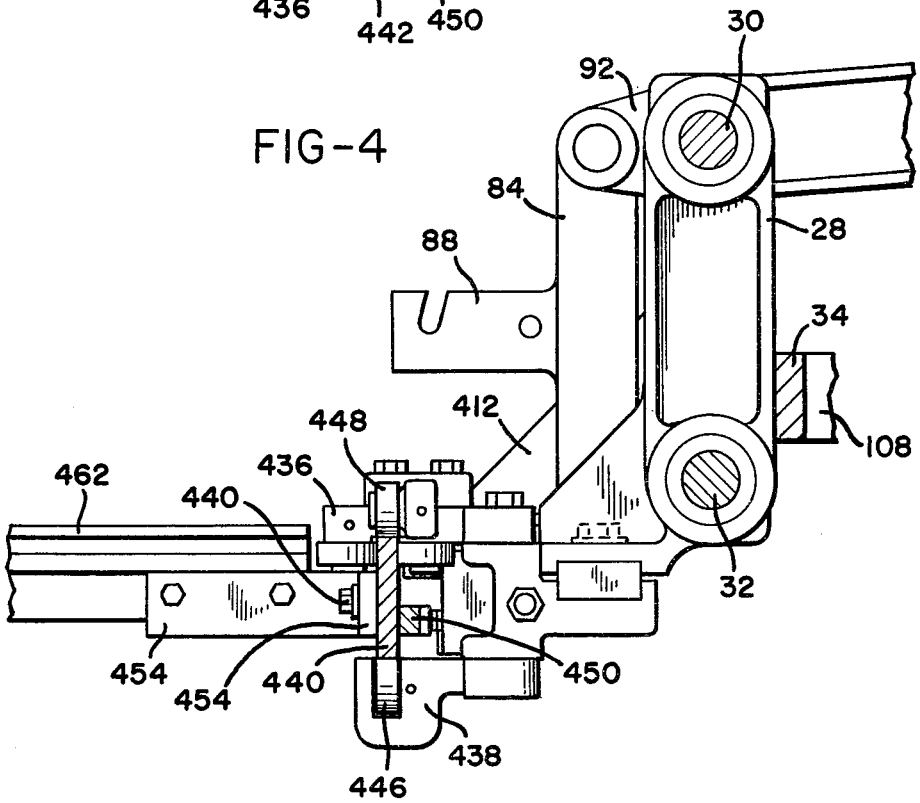
FIG. 4 is a partial cross sectional view along the line 4—4 of FIG. 1 illustrating the rack support means mounted to one side of the silk screen carrier.
Figure 5:
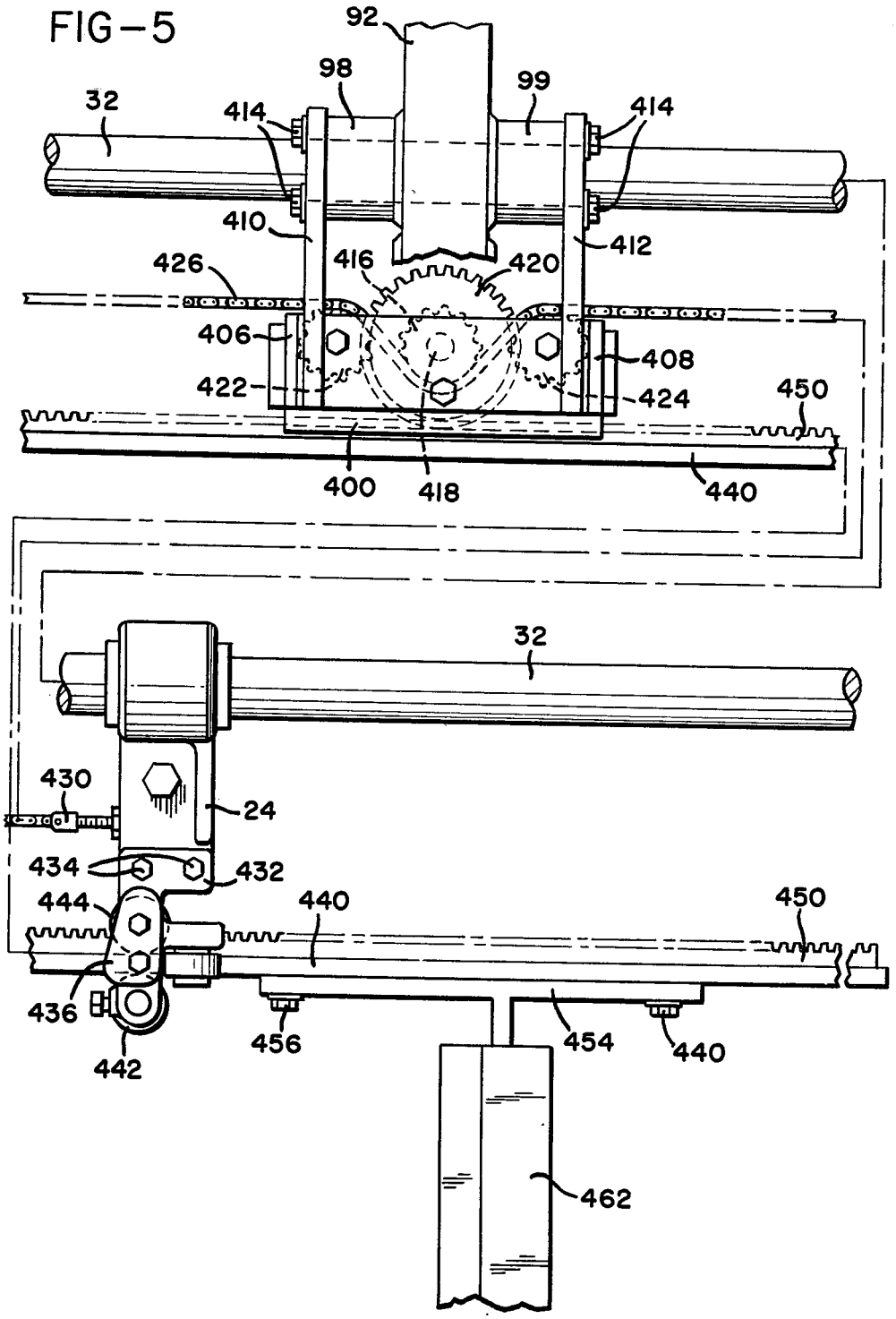
FIG. 5 is an expanded partial top view of the central bracket member, rack member and rack support means, mounted on the means supporting the silk screen carrier.

Referring now to the details of the preferred embodiment of the present invention as it is mounted to the above described exemplary silk screen machine, the attachment is supported in part by a central bracket 400 as illustrated in FIG. 5, which has a rectangular cross section and is open in the fore and aft directions as shown in FIG. 3, for example. Bracket 400 has upper and lower plates 402 and 404 which are secured together with two end plates 406 and 408 to form the open front and back box-like structure. A pair of angular braces 410 and 412 are secured to the top plate 402 on their lower end portions and extend rearwardly and upwardly. They are secured at their upper end portions by bolts 414 to auxiliary support plates 98 and 99, to securely hold the central bracket 400 in position aligned with the squeegee, but supported by the screen carrier support means, i.e. bars 30 and 32 via the auxiliary support plates 98 and 99.

Mounted within upper and lower plates 402 and 404 are a rotary drive member, which in this preferred embodiment is the sprocket 416, which is mounted on a common shaft 418 with the pinion gear 420 for rotation therewith. A pair of guide members or sprockets 422 and 424 are also mounted for rotation between upper and lower plates 402 and 404 for guiding the flexible connector or drive chain 426 about a portion of sprocket 416 to provide a positive engagement between the drive chain 426 and sprocket 416.

Drive chain 426 is connected respectively at each of its end portions by a turn buckle connector 430 to support bars 22 and 24 which form the previous silk screen carrier. Drive chain 426 is disposed in parallel aligned relation with support bars 30 and 32 so that lateral movement of support bars 22 and 24 and other portions of the silk screen carrier means, will not cause binding between the drive sprocket 416 and drive chain 426.

Also secured to each of the support bars 22 and 24 at the outer ends thereof, as best illustrated in FIG. 5 as to support bar 24, are a pair of rack support means which form a second part of the attachment means for securing the attachment of the present invention to the silk screen carriers of the existing equipment. Since these rack support means are but mirror images of one another, for the sake of clarity, a description will be given of only the rack support means illustrated in FIG. 5. The rack support means includes a bracket 432 bolted by bolts 434 to the outer end portion of support bar 24. Bracket 432 has an outwardly extending upper portion 436 and an outwardly extending lower portion 438 to form a generally U-shaped structure which mates with the rack 440 described in detail below.

A pair of horizontally disposed rollers 442 and 444 are each rotatably secured to upper portion 436 of the bracket 432 and in engagement with opposite sides of the horizontally extending parallel surfaces of rack 440 to act as a guide to maintain the rack 440 in a stable horizontal position. A further roller 446 is vertically positioned in the lower portion 438 of bracket 432 and supports the rack 440. A further roller 448 is vertically positioned in engagement with the upper surface of rack 440 and is mounted in the upper portion 436 of bracket of 432. All of these rollers then maintain the rack in both vertical and horizontal alignment and support the rack for movement back and forth laterally, independently of the movement of support bars 22 and 24.

The rack member 440 has secured to the rear surface thereof, the rack 450 which is disposed for meshing engagement with pinion gear 420 and is driven thereby upon rotation of pinion gear 420 upon lateral movement of the support bars 22 and 24 which move drive chain 426 through sprocket 416. Rack 450 extends substantially the entire length of rack member 440 and is secured thereto so that the rack member 440 is moved back and forth along with the rack 450.

Also secured to the rack member 440 are a pair of slotted T-shaped brackets 452 and 454 which are held in position by bolt 456 extending through the slots in the brackets and into the rack member 440. A plurality of holes 458 are spaced along the face of rack member 440 for securing the T-shaped brackets 452 and 454 at any desired relative spacing. T-shaped brackets 452 and 454 have bolted thereto the silk screen carrier mounting members 460 and 462 to which the silk screen is actually mounted.

Thus, it can be seen that in operation of the attachment of the present invention, when the carrier support members 26 and 28 of the existing silk screening machine are moved laterally back and forth they carry therewith the drive chain 426 secured at its ends to support bars 22 and 24. As the drive chain is moved it rotates sprocket 416 which in turn rotates pinion gear 420 to cause the rack 450 and rack member 440 to move laterally back and forth at a rate different from the rate of movement of the carrier support members 26 and 28, which difference in movement depends upon the relative size of sprocket 416 and pinion gear 420. Thus, in turn, a substantially greater length of movement of the silk screen can be obtained with the attachment of the present invention than is the case with the silk screen being secured to the carrier support members 26 and 28 of the basic silk screening machine.

Although the foregoing description illustrates the preferred embodiments of the present invention, other variations are possible. All such variations as would be obvious to one skilled in this art are intended to be included within the scope of the invention as defined by the following claims.

What is claimed is:

1. A long stroke attachment assembly for use with a screen printing machine for printing on objects of revolution having surfaces of large diameters, said long stroke attachment assembly having a drive means, screen support means and a squeegee support means, each of said screen support means and said squeegee support means engageable with said drive means for reciprocal vertical movement both in concert and relative to one another; said screen support means being capable of causing lateral reciprocal movement of a screen mounted thereto;

a rack member connected to said screen for following lateral reciprocal movement;

a pinion gear mounted for rotation on said screen support means in driving engagement with said rack member;

a sprocket wheel fixedly secured in axial alignment with said pinion gear, said sprocket wheel engaged with a chain, said chain being connected to said drive means for rotating said sprocket wheel and said pinion gear secured thereto;

whereby the relative diameters of said sprocket wheel and said pinion gear determine the length of stroke of said screen in said lateral movement, the stroke length thereby being adjustable to a longer stroke for printing on the surfaces of objects having a large diameter.

2. The screen printing machine of claim 1 wherein a pair of idler rollers are mounted on opposite sides of said sprocket wheel for providing a guide for alignment of said chain with said sprocket.

3. The screen printing machine of claim 1 wherein said screen is connected to said drive means by a turn buckle connector for adjustments in tension of said chain.

* * * * *